US007353914B2

(12) United States Patent
Deplazes

(10) Patent No.: US 7,353,914 B2
(45) Date of Patent: Apr. 8, 2008

(54) SAFETY SYSTEM FOR AN ELEVATOR

(75) Inventor: Romeo Deplazes, Oberruti (CH)

(73) Assignee: Inventio AG, Hergiswil (CH)

( * ) Notice: Subject to any disclaimer, the term of this patent is extended or adjusted under 35 U.S.C. 154(b) by 517 days.

(21) Appl. No.: 10/953,440

(22) Filed: Sep. 29, 2004

(65) Prior Publication Data

US 2005/0082121 A1 Apr. 21, 2005

(30) Foreign Application Priority Data

Oct. 20, 2003 (EP) ..... 03405757

(51) Int. Cl.
*B66B 13/02* (2006.01)

(52) U.S. Cl. ..... 187/313; 187/249

(58) Field of Classification Search ..... 187/313, 187/314, 316, 317, 391–393, 36, 339, 249, 187/336

See application file for complete search history.

(56) References Cited

U.S. PATENT DOCUMENTS 2,854,095 A 9/1958 White
4,708,224 A 11/1987 Schrooder
5,004,076 A 4/1991 Chen et al.
5,419,414 A 5/1995 Sakita
5,490,580 A 2/1996 Powell et al.
5,877,462 A 3/1999 Chenais
6,161,652 A 12/2000 Kostka et al.
6,619,437 B2 * 9/2003 Hikita ..... 187/383
7,178,635 B2 * 2/2007 Meissner et al. ..... 187/249

FOREIGN PATENT DOCUMENTS

EP 1 357 075 A1 10/2003
EP 1 371 596 A1 12/2003

* cited by examiner

*Primary Examiner*—Jonathan Salata
(74) *Attorney, Agent, or Firm*—Klaus P. Stoffel; Wolff & Samson PC

(57) ABSTRACT

A safety system for an elevator installation for the transport of persons/goods in a building and a method for operating an elevator installation with a safety system. Several cages are moved one above the other in a shaft. Each cage is moved by a drive. At least one drive control controls the drives by way of drive control signals. Cage position detecting sensors detect positions of each cage and transmit cage position data to at least one safety control. Access to the shaft takes place by way of opened shaft doors. A lock locks the shaft doors. Lock setting detecting sensors detect settings of the locks of the shaft doors and transmit lock setting data by way of the data bus to the safety control. The safety control ascertains, from the cage position data and the lock setting data, shaft region data with details with respect to shaft regions in which each cage is safely movable. The safety control transmits the shaft region data to the drive control, which converts the shaft region data into drive control signals in order to move the cages in separate shaft regions and in order to move the cages in shaft regions with locked shaft doors.

19 Claims, 3 Drawing Sheets

SAFETY SYSTEM FOR AN ELEVATOR

BACKGROUND OF THE INVENTION

The invention relates to a safety system for an elevator installation for the transport of persons/goods in a building and to a method of operating the elevator installation with a safety system.

U.S. Pat. No. 5,419,414 shows an elevator installation with cages which are arranged one above the other in a shaft of a building and are movable independently of one another. Each cage has a drive and a counterweight. The cages are connected with the counterweights by way of cables as drive means. The drives are mounted above the shaft and move the drive means. The drives are controlled by drive control signals from a drive control. Cage position detecting sensors detect the positions of the cages and transmit cage position signals to the drive control.

SUMMARY OF THE INVENTION

A first object of the present invention is to provide a safety system for such an elevator installation, which comprises means for avoiding collisions between cages moved independently of one another in a shaft.

A second object of the invention is to provide a safety system for an elevator installation, which comprises means for restricting movement of cages, which movements take place independently of one another in a shaft, to storey regions with closed storey doors.

A third object of the invention is to provide a safety system for an elevator installation, which comprises means for avoiding collisions of cages, which move independently of one another in a shaft with shaft ends.

These objects are to be realized by known and proven means of elevator construction.

The invention relates to a safety system for an elevator installation for the transport of persons/goods in a building and to a method of operating an elevator installation with a safety system. Several cages are moved one above the other in a shaft. Each cage is moved by a drive. At least one drive control controls the drives by way of drive control signals.

Cage position detecting sensors detect positions of each cage and transmit cage position data to at least one safety control. Access to the shaft takes place by way of opened shaft doors. A lock locks shaft doors. Lock setting detecting sensors detect settings of the locks of the shaft doors and transmit lock setting data to the safety control.

The safety control determines, from the cage position data and the lock setting data, shaft region data with details with respect to shaft regions in which each cage is safely movable.

According to the invention provision of cage position data and lock setting data to a safety control, which based on these data determines shaft regions in which the cages are movable with safety, is thus carried out. Advantageously a shaft region in which a cage is safely movable is such a shaft region in which the cage can move to a next storey stop with maintenance of a safety spacing from a next cage or from the shaft end and with normal retardation as seen in travel direction of the cage and stop there. Advantageously the safety control transmits the shaft region data to the drive control, which converts the shaft region data into drive control signals in order to move the cages in separate shaft regions and in order to move the cages in shaft regions with locked shaft doors.

Advantageously the cage position detecting sensors, the lock setting detecting sensors, the safety control and the drive control are modular components of the safety system. These components communicate with one another by way of a data bus. The advantages of the data bus reside in that on the one hand data can be rapidly transmitted from and to the safety control and that on the other hand the sensors of the cage positions and the lock settings are selectively controllable in simple and individual manner. This rapid communication and this selective control of the sensors takes place with a very favorable cost/performance ratio. In addition, this modular safety system is simple to install and to maintain.

In a first embodiment of the invention the safety control is advantageously a central unit. The central safety control receives all cage position data of the cages, it receives all lock setting data of the shaft doors and it transmits all shaft region data to a central drive control. In a second embodiment the safety control advantageously consists of decentralized units. Each cage is individually associated with a safety control and drive control. Cage position data are transmitted only to the safety control associated with the cage. The safety controls exchange detected cage position data with one another. Lock setting data are transmitted to all safety controls. Shaft region data are transmitted only to the drive control associated with the cage.

The drive control controls, by the shaft region data provided by the safety control, the drives and thus prevents collision of cages in the shaft, collision of cages with shaft ends and travel past open shaft doors.

Advantageously the safety control monitors whether safety-critical spacings are exceeded. In the case of exceeding a safety-critical spacing, predefined safety measures are initiated. A first safety measure is retardation of at least one drive. A further safety measure is emergency braking of at least one drive. Still another safety measure is engagement of at least one safety braking device of the cages. These safety measures can be triggered in a staggered manner or in combination.

Advantageously, the safety control checks the serviceability of the sensors with serviceability interrogations, which increases safety of the elevator installation. Thus, cage position data and lock setting data transmitted to the safety control can be checked with respect to transmission error. In addition, the sensors can be interrogated, in the manner of a test, with respect to functional capability at periodic intervals in time.

Other features and advantages of the present invention will become apparent from the following description of the invention which refers to the accompanying drawings.

BRIEF DESCRIPTION OF THE DRAWINGS

The invention is explained in detail in the following by way of example, wherein.

DETAILED DESCRIPTION OF THE INVENTION

Figure 1:
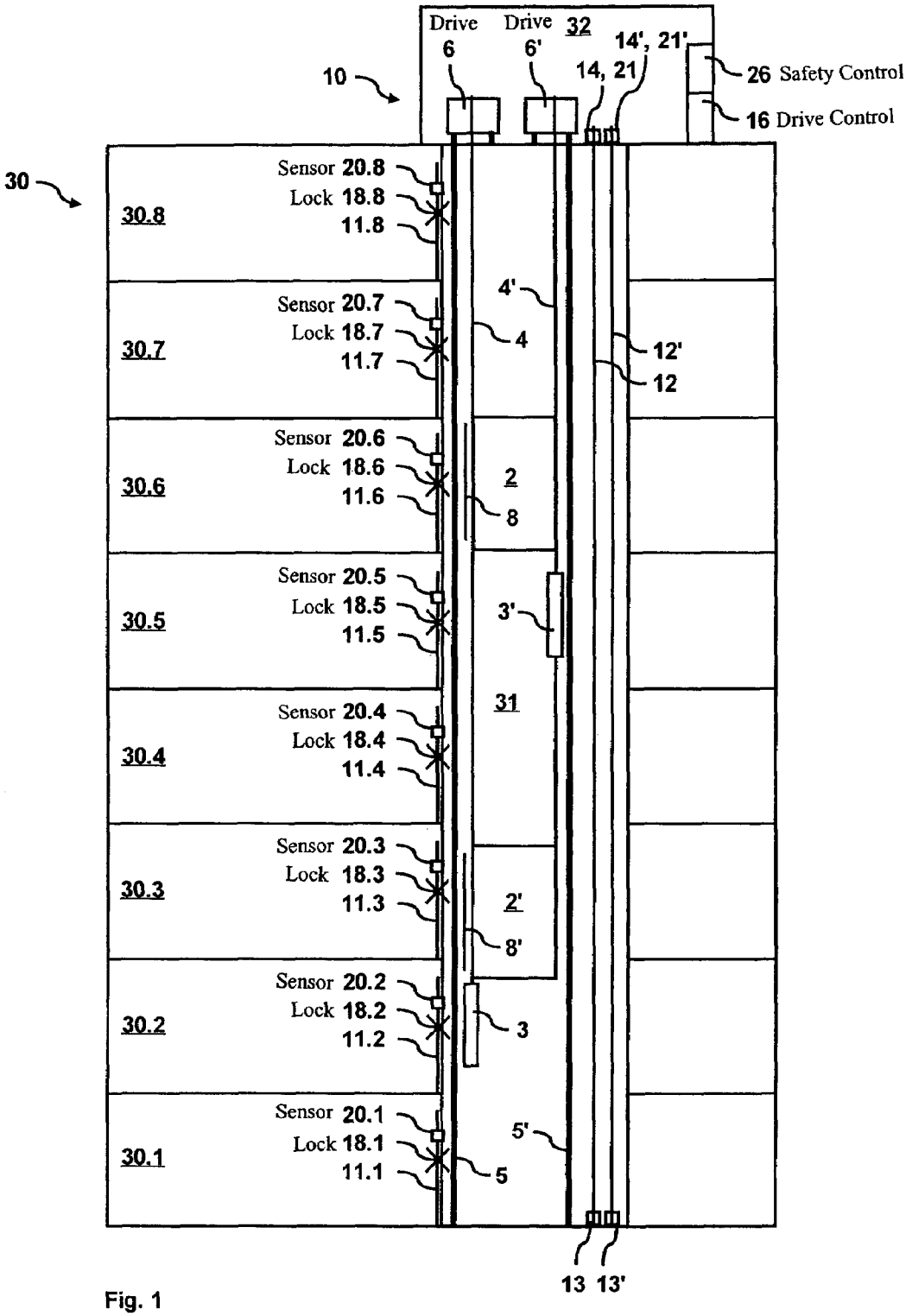
FIG. 1 shows a schematic illustration of a part of a first embodiment of an elevator installation with two cages moved independently of one another in a shaft and a central safety control for the two cages.
Figure 2:
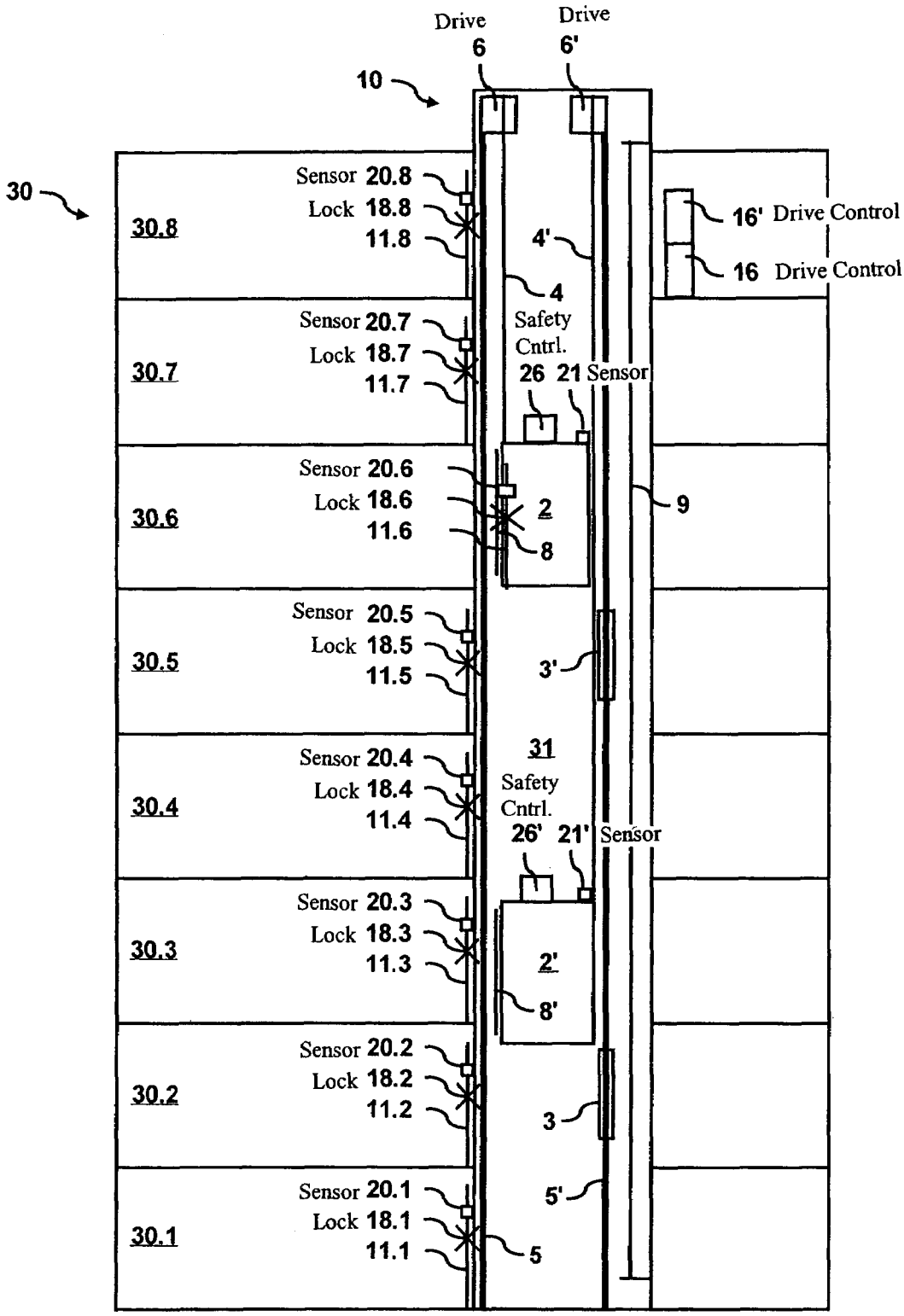
FIG. 2 shows a schematic illustration of a part of a second embodiment of an elevator installation with two cages moved independently of one another in a shaft and a safety control for each cage.

Building/shaft: FIGS. 1 and 2 show two different embodiments of an elevator installation 10 for conveying persons/goods between the storeys 30.1 to 30.8 of a building 30. The elevator installation 10 comprises at least one elevator which is advantageously installed in a shaft 31 of the building 30. Numerous possibilities of variation in the installation of an elevator in a building 30 are freely available to one skilled in the art. Thus, the shaft might extend only partly through the building 30 or the elevator is installed, without a shaft, in a courtyard of the building 30 or outside the building 30.

Cages: The elevator comprises at least one cage 2, 2', which cages 2, 2' are moved as single or double cages in a vertical travel direction advantageously at a pair of guide rails 5, 5'. The cages 2, 2' are conventional and proven elevator cages which are moved at the guide rails 5, 5' by way of guide shoes. Each cage has at least one cage door 8, 8', by way of which persons/goods have access to the cage 2, 2'. With knowledge of the present invention there can obviously also be used cages which are moved at a single guide rail or also at more than two guide rails.

Drives/drive means: The elevator installation has a drive 6, 6' for each cage 2, 2'. The drives are advantageously drive pulley drives with drive pulleys which connect the cages 2, 2' by way of drive means 4, 4' with counterweights 3, 3'. Advantageously, each cage 2, 2' is connected with a counterweight 3, 3' by way of at least one drive means 4, 4', which drive means 4, 4' are driven by drive pulleys through friction couple. The cages 2, 2' and the counterweights 3, 3' are, in the illustrations according to FIGS. 1 and 2, arranged in different planes. The drive means 4, 4' can have any desired form and can also be of any desired materials. For example, the drive means 4, 4' can be a round cable, a double cable or a belt. For example, the drive means 4, 4' is at least partly of steel or aramide fibers. With knowledge of the present invention the expert can use all known and proven drives 6, 6'. For example, gearless drive or drives with gears can be used. In addition, drives 6, 6' with permanent magnets, with a synchronous motor, with an asynchronous motor or with linear motors can be used. The drives 6, 6' can, as shown in the embodiment according to FIG. 1, be arranged in a stationary position in a separate engine room 32 or, as shown in the embodiment according to FIG. 2, in a stationary position directly in the shaft 31. Here, too, with knowledge of the present invention one skilled in the art has free choice of the arrangement of the drives. For example, the drives 6, 6' can, as illustrated in the embodiment according to FIG. 1, be arranged at the upper end of guide rails 5, 5' at substantially the same height in the shaft 31. Finally, the drives do not have to be arranged to be stationary, but they can also be disposed on the cages or the counterweights to be mobile.

Drive control: The drives 6, 6' are controlled by way of at least one drive control 16, 16'. In the embodiment according to FIG. 1, a central stationary drive control 16 with at least one computer unit and at least one memory is provided for both drives 6, 6' in the engine room 32. In the embodiment according to FIG. 2, a separate stationary drive control 16, 16' with at least one computer unit and at least one memory is provided for each drive 6, 6' in the vicinity of the shaft 31. At least one control program, which is executed by the computer unit, is stored in the memory. For this purpose the drive control 16, 16' transmits drive control signals to the drives 6, 6' in order to accelerate, brake or stop these in accordance with at least one programmed travel plot. The drive control can obviously also be arranged on the cages or counterweights to be mobile. In addition, a central drive control or several drive controls for each cage can be arranged in such a manner to be mobile.

Cage position detecting sensors: The elevator installation 10 comprises at least one cage position detecting sensor 21, 21' for detecting the current absolute position of each of the cages 2, 2' moved independently of one another in the shaft 31.

In a first preferred embodiment according to FIG. 1, a coding is applied to a speed limiter cable 12, 12'. Each cage 2, 2' has a speed limiter cable 12, 12' which is arranged in the shaft 31 near the cage 2, 2' and mechanically fixedly connected with the cage 2, 2'. The upward and downward movement of the cages 2, 2' in the shaft 31 is thus transmitted to the speed limiter cable 12, 12'. For reasons of clarity, the distances in FIG. 1 between the cages 2, 2' and the speed limiter cables 12, 12' are not to scale. Each speed limiter cable 12, 12' is mechanically connected with a speed limiter 14, 14' arranged in the engine room 32. The speed limiter 14, 14' detects excess speed of the cage 2, 2' and in the case of excess speed triggers at least one of the safety measures described further below. A deflecting roller 13, 13' arranged at the shaft base makes possible the return run of the speed limiter cable 12, 12'. In this first embodiment the cage position detecting sensor 21, 21' is mounted in the engine room 32 at the speed limiter 14, 14'. The cage position detecting sensor 21, 21' can decode optical codings such as color codings or magnetic codings on the speed limiter cable 12, 12'. The decoding can be carried out by the cage position detecting sensor 21, 21' or by the safety control 26, 26'.

This first embodiment is not obligatory for the expert. The cage position detecting sensor 21, 21' can also be arranged in the shaft 31. The expert can obviously also apply codings to the drive means 4, 4' of each cage 2, 2' and detect codings, which are applied to the drive means 4, 4', by means of cage position detecting sensors 21, 21'. In addition, the expert can apply mechanical markings, such as balls or hooks, which are detected by appropriately designed mechanical cage position detecting sensors 21, 21', to the speed limiter cable 12, 12' or to the drive means 4, 4'. For example, a marking is provided for a cable unit length of 10 centimeters. Through counting of the markings the current position of the cages 2, 2' with respect to a specific known starting position can thus be determined. The counting of the markings can be carried out by the cage position detecting sensor 21, 21' or by the safety control 26, 26'. With knowledge of the present invention the expert can obviously also define smaller or larger cable unit lengths.

In a second preferred embodiment according to FIG. 2, the cage position detecting sensor 21, 21' is a magnet sensor which is mounted at the cage 2, 2' and which scans a coded magnetic strip 9, which is mounted in the shaft 31, with high resolution. Codings on the magnetic strip 9 are decoded into a current absolute position of the cage 2, 2'. The decoding can be carried out by the cage position detecting sensor 21, 21' or by the safety control 26, 26'. A rectilinear disposition, for example adjacent to at least one guide rail 5, 5', allows use of a magnetic strip 9 with high information density.

This second embodiment is also not obligatory for the expert. The cage position detecting sensors 21, 21' can also be an optical sensor which is mounted on the cage 2, 2' and which detects any patterns in the shaft 31 as cage position data. These patterns are detected and stored as primary cage position data in a calibrating travel. In operation of the elevator installation 10, instantaneously detected cage position data are compared with the stored primary cage position data. The storage and comparison of cage position data can be carried out by the cage position detecting sensor 21, 21' or by the safety control 26, 26'. The expert can also apply mechanical markings, such as balls or hooks, which are detected by appropriately designed mechanical cage position detecting sensors 21, 21', in the shaft 31. For example, a marking is provided at at least one guide rail 5, 5' at every 10 centimeters. The current position of the cage 2, 2' with respect to a defined known starting position can thus be determined by counting the markings. Counting of the markings can be carried out by the cage position detecting sensor 21, 21' or by the safety control 26, 26'. Finally, the cage position detecting sensor 21, 21' mounted on the cages 2, 2' can also detect the relative spacing between cages 2, 2'.

Finally, the expert can apply codings otherwise than over the entire length of the shaft 31 or detect patterns otherwise than over the entire length of the shaft 31 or apply them otherwise than to the entire length of the speed limiter cable 12, 12' or drive means 4, 4'. Thus, the expert can apply or detect codings or patterns only in such regions of the shaft 31 where an actual risk of collision of cages 2, 2' in the shaft 31 or an actual risk of collision of cages 2, 2' with shaft ends exists. Detection of the cage position data advantageously takes place continuously, for example at regular intervals in time of 10 milliseconds.

Shaft doors/locks: Access to the shaft 34 takes place in each storey 30.0 to 30.8 by way of shaft doors 11.0 to 11.8. The shaft doors 11.0 to 11.8 can be doors opening to one side or to both sides. The shaft doors 11.0 to 11.8 are preferably constructed to be self-shutting, i.e. they close automatically as soon as they are not actively held open. In addition to closing of the shaft doors 11.0 to 11.8, closed shaft doors 11.0 to 11.8 are locked. For this purpose each shaft door 11.0 to 11.8 comprises a lock 18.0 to 18.8. The lock 18.0 to 18.8 is self-shutting when the shaft door 11.0 to 11.8 is closed. An active locking is not necessary. With knowledge of the present invention the expert can undertake numerous variations in this connection. For example, the locks 18.0 to 18.8 are preferably so constructed for reasons of safety that they can unlock and open or close and lock only by a cage door 8, 8' provided at a cage 2, 2' or that they can unlock by a special tool and slide back by hand.

Lock setting detecting sensors: Each shaft door 11.0 to 11.8 comprises at least one lock setting detecting sensor 20.0 to 20.8. The lock setting detecting sensor 20.0 to 20.8 detects settings of the locks 18.0 to 18.8 of the shaft doors 11.0 to 11.8. Sensors which are known to the expert in elevator construction and are proven, such as locking device contacts, microswitches, inductive sensors such as, for example, radio-frequency identification (RFID) sensors, capacitive sensors or optical sensors, etc., can be used as lock setting detecting sensors. The detection of the lock setting data is preferably carried out continuously, for example at regular intervals in time of 10 milliseconds.

Figures 3, 4:
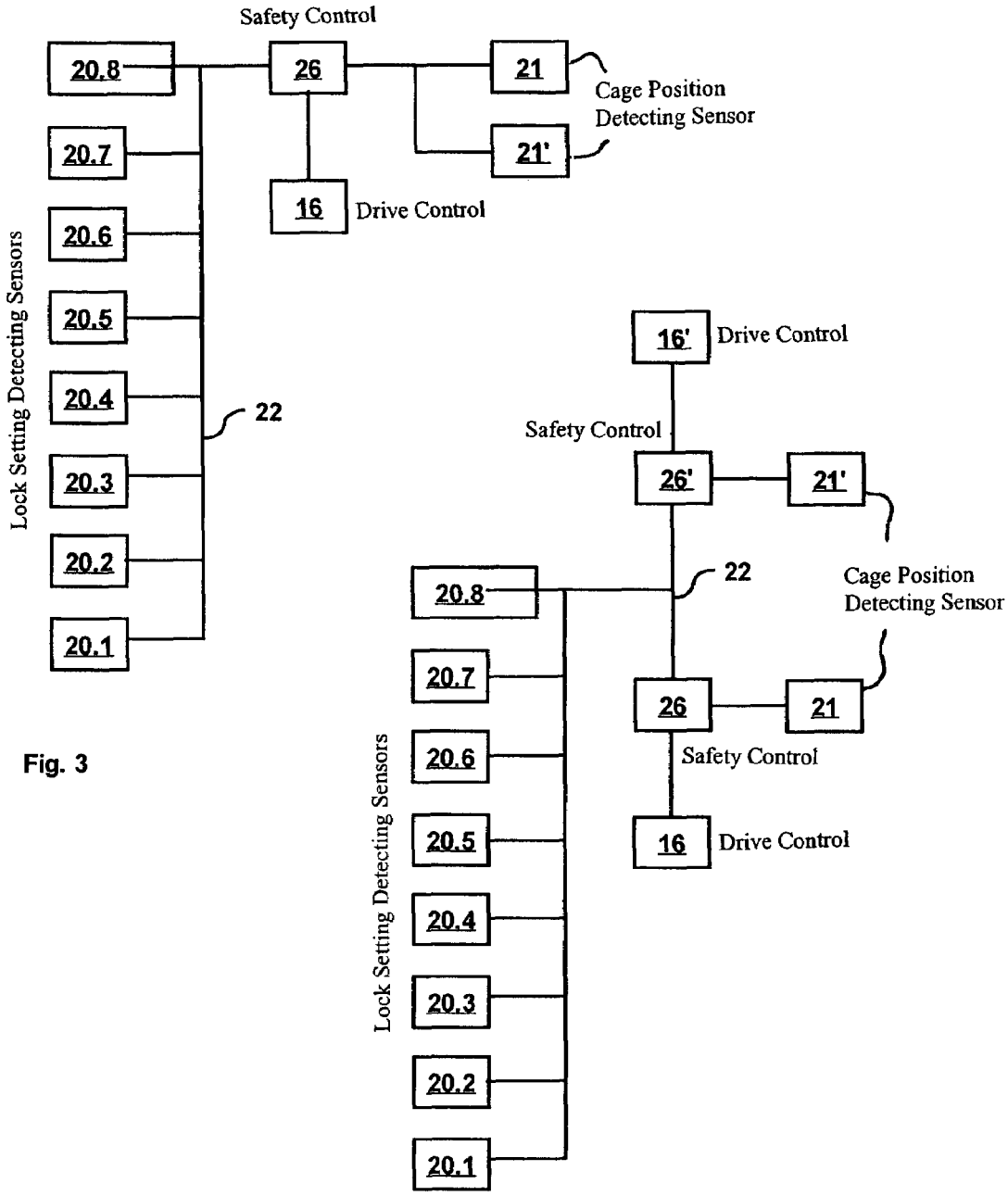
FIG. 3 shows a schematic illustration of a first embodiment of the components of the safety installation for an elevator installation according to FIG. 1.
FIG. 4 shows a schematic illustration of a second embodiment of the components of the safety system for an elevator installation according to FIG. 2.

Safety control/data bus: At least one safety control 26, 26' is provided which, as illustrated in FIGS. 3 and 4 by way of example, receives communication, by way of a data bus 22, of cage position data determined by the cage position detecting sensors 21, 21' and lock setting data determined by the lock setting detecting sensors 20.0 to 20.8 and which transmits shaft region data to the drive control 16, 16' by way of the data bus 22. The safety control 26, 26' advantageously comprises at least one computer unit and at least one memory. At least one safety program is stored in the memory and is executed by the computer unit.

The safety control 26, 26' monitors whether safety-critical spacings are exceeded. These spacings are described in detail further below. In the case of exceeding a safety-critical spacing, predefined safety measures are initiated. A first safety measure is slowing down by means of a drive 6, 6'. A further safety measure is emergency braking, i.e. engagement of the stopping brake of at least one drive 6, 6'. A further safety measure is engagement of at least one safety braking device of the cages 2, 2'. The first and further safety measures can be triggered to be staggered or in combination. Thus, a slowing down can be initiated as first safety measure. If the safety-critical spacing decreases further, an emergency braking can be additionally initiated as a further safety measure. If the safety-critical spacing still decreases, engagement of a safety braking device can additionally be carried out as a further safety measure. With knowledge of the present invention the expert can obviously also undertake other forms of bringing the cages 2, 2' to a standstill. Thus, for example, the expert can provide a cage brake in the form of a brake disc. In addition, the expert can provide braking of the drive means.

The data bus 22 is a known and proven signal bus. It can be a signal bus on the basis of electrical or optical signal transmission, such as an Ethernet network, a Tokenring network, etc. In addition, it can be a radio network, an infrared network, a radar network, a radio beam network, etc. The transmission media such as twin-wire, 230/400 VAC mains, radio, infrared, microwave, fibre-optic, Internet, etc., can be freely selected.

The safety system thus consists of the components of cage position detecting sensors 21, 21', lock setting detecting sensors 20.0 to 20.8, safety control 26, 26' and drive control 16, 16', which communicate with one another by way of the data bus 22. The components of the safety system are advantageously bus modules. A bus module is an electronic card with at least one data memory and at least one computer unit. Advantageously, the data bus 22 is an LON bus where bus modules directly communicate with one another in simple manner and are programmable. The LON bus is a technology which enables construction of decentrally controlled networks with use of numerous simple bus nodes. In particular, a direct communication between the individual computer units of the components is possible. The LON bus protocol is the carrier of control information and the individual computer units of the components can be directly controlled by way of the LON bus. The bus nodes can be programmed with logical links. The LON bus has a free topology and can be structured in lines, circles, trees, etc. The data bus 22 has, for example, a branched topology.

In the first embodiment according to FIG. 3 the cage position detecting sensors 21, 21' and the lock setting detecting sensors 20.0 to 20.8 are monitored in common by a central safety control 26. The central safety control 26 transmits shaft region data to a central drive control 16.

In the second embodiment according to FIG. 4 each cage 2, 2' comprises a safety circuit 26, 26'. A first cage position detecting sensor 21 of a first cage 2 is monitored by a first safety control 26. A second cage position detecting sensor 21' of a second cage 2' is monitored by a second safety control 26'. The two safety controls 26, 26' reciprocally exchange detected cage position data. The lock setting detecting sensors 20.0 to 20.8 are monitored by the two safety controls 26, 26'. The first safety controls 26 transmit shaft region data to the drive control 16 of the drive 6 of the first cage 2 and the second safety controls 26' transmit shaft region data to the drive control 16' of the drive 6' of the second cage 2'.

The data bus 22 thus makes possible two important functions, namely rapid transmission of data and interrogation of the serviceability of the sensors of the safety system.

Serviceability interrogations: Advantageously, the safety control 26, 26' is so constructed that it evaluates the cage position data or the lock setting data in order to trigger one or more predefined reactions, particularly recognition and localization of a fault, triggering of a service call, stopping of a cage 2, 2' or performance of another situation-adapted reaction on recognition of risk-laden mutual approach of the cages 2, 2' or the remaining open of a shaft door 11.0 to 11.8.

Advantageously the safety control 26, 26' is so constructed that it evaluates the cage position data or the lock setting data in order to correct established transmission errors by evaluation of several data packets.

With respect to the safety of the elevator installation 10 it is particularly advantageous if in addition to monitoring of the shaft doors 11.0 to 11.8 the cage doors 8, 8' are also monitored; a statement about the functional integrity of the lock setting detecting sensors 20.0 to 20.8 is thereby gained by means of coincidence checking of the signals of the shaft doors 11.0 to 11.8 on the one hand and the cage doors 8, 8' on the other hand.

The safety control 26, 26' so evaluates the transmitted lock setting data, for example, that it interrogates the lock setting detecting sensors 20.0 to 20.8 at periodic intervals of 20 milliseconds. In this manner a communications breakdown in the region of the data bus 22 or the bus nodes can thus be detected very rapidly. Advantageously each lock setting detecting sensor 20.0 to 20.8 is periodically tested at greater intervals in time, for example once within 8 or 24 hours. For that purpose the corresponding shaft doors 11.0 to 11.8 are opened and closed again or at least the contacts are actuated (unlocked/locked) and it is observed whether in that case anticipated lock setting data are transmitted to the safety control 26. This test can be carried out on opening and closing of the shaft doors 11.0 to 11.8 in normal operation. If a storey 30.0 to 30.8 was not travelled to within the predetermined time period of 8 or 24 hours then for test purposes a test travel to this storey 30.0 to 30.8 is initiated by the safety control 26, 26' (forced test). Advantageously the execution of all tests is monitored by the safety control 26, 26' and entered and stored in a table.

Safe shaft regions: The safety control 26, 26' determines, for the cages 2, 2', safe shaft regions in which the cages can move to a next storey stop with maintenance of a defined safety spacing from a next cage 2, 2' or from the shaft end and with normal retardation as seen in the travel direction of the cage 2, 2' and can stop there. Safe shaft regions are thus such shaft regions in which the cages 2, 2' can move without initiation of further safety measures such as emergency braking, i.e. engagement of the stopping brake or engagement of a safety braking device. For this purpose there is filed in the safety program at least one travel plot according to which the cages 2, 2' are accelerated, braked or stopped by the drives 6, 6'. Advantageously the travel plot has three regions, namely an acceleration region where the cages 2, 2' are accelerated at predetermined normal acceleration, a speed region where the cages 2, 2' are moved at predetermined normal speed and a braking region where the cages 2, 2' are braked at predetermined normal retardation. By normal acceleration and normal retardation there are understood acceleration and retardation sensed by persons as pleasant and acceptable.

The safety spacing is a function of the current speeds and travel directions of the cages 2, 2'. The cages 2, 2' are moved at a safety spacing which is the same as the total braking travel during normal retardation. This is clarified by the following case examples:

For two cages 2, 2' travelling towards one another at normal speed the safety spacing is equal to twice the full braking travel with normal retardation.

If a first cage 2 travels at normal speed towards a stationary second cage 2' then the safety spacing is equal to one full braking travel at normal retardation.

If a cage 2, 2' travels at normal speed towards a shaft end or towards opened shaft doors 11.0 to 11.8 then the safety spacing is equal to one full braking travel at normal retardation.

Based on the current data with respect to cage positions and the lock settings the safety program advantageously ascertains in real time for each cage 2, 2' a safe shaft region. With knowledge of the present invention the expert can obviously use other definitions of a safety spacing. For example, the expert can employ a stronger retardation and the expert can also initiate an emergency braking, i.e. engagement of the stopping brake.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A safety system for an elevator installation for transporting of persons/goods in a building, comprising:

a shaft;

at least two cages which are arranged above one another so as to move independently of one another in the shaft;

a drive for each cage;

at least one drive control for controlling the drives;

cage position detecting sensors for detecting positions of each cage in the shaft;

at least one safety control, the cage position detecting sensors being operative to transmit cage position data to the at least one safety control;

shaft doors arranged to close accesses to the shaft;

locks operatively arranged to lock the shaft doors; and lock setting detecting sensors operative to detect settings of the locks, the lock setting detecting sensors being further operative to transmit lock setting data to the safety control, the safety control being operative to ascertain from the cage position data and the lock setting data shaft region data having details with respect to shaft regions in which each cage is safely movable.

2. The safety system according to claim 1, wherein the safety control is operative to transmit the shaft region data to the drive control and the drive control is operative to convert the shaft region data into drive control signals.

3. The safety system according to claim 2, wherein the cage position detecting sensors are operative to transmit cage position data, and the lock setting detecting sensors are operative to transmit lock setting data, via a data bus to the safety control and/or the safety control transmits shaft region data by way of the data bus to the drive control.

4. The safety system according to claim 3, wherein the safety control is a central safety control and the drive control is a central drive control, the cage position detecting sensors transmit cage position data to the central safety control, the lock setting detecting sensors transmit lock setting data to the central safety control and the central safety control transmits shaft region data to the central drive control for all cages.

5. The safety system according to claim 3, wherein a cage position detecting sensor of a first cage transmits cage position data to a first safety control, a cage position detecting sensor of a second cage transmits cage position data to a second safety control and the two safety controls mutually exchange cage position data of the two cages.

6. The safety system according to claim 5, wherein the lock setting detecting sensors transmit lock setting data to the two safety controls.

7. The safety system according to claim 5, wherein the first safety control transmits shaft region data to a first drive control for controlling a drive of the first cage and the second safety control transmits shaft region data to a second drive control for controlling the drive of the second cage.

8. The safety system according to claim 6, wherein the first safety control transmits shaft region data to a first drive control for controlling a drive of the first cage and the second safety control transmits shaft region data to a second drive control for controlling the drive of the second cage.

9. The safety system according to claim 1, wherein the cage position detecting sensors are optical or magnetic sensors which detect optical or magnetic codings of a speed limiter cable or of a drive means.

10. The safety system according to claim 1, wherein the cage position detecting sensors are mechanical sensors which detect mechanical markings of a speed limiter cable or of a drive means.

11. The safety system according to claim 1, wherein the cage position detecting sensors are magnetic sensors which detect codings of a magnetic strip mounted in the shaft.

12. The safety system according to claim 1, wherein the cage position detecting sensors are optical sensors which detect patterns in the shaft.

13. The safety system according to claim 1, wherein the cage position detecting sensors are mechanical sensors which detect markings in the shaft.

14. A method of operating an elevator installation for transporting persons/goods in a building, having at least two cages which are arranged above one another and are movable independently of one another in a shaft, a drive for each cage, at least one drive control for controlling the drives and cage position detecting sensors for detecting positions of each cage in the shaft, the method comprising the steps of:

transmitting cage position data to at least one safety control;

closing accesses to the shaft with shaft doors;

locking the shaft doors with locks;

detecting settings of the locks with lock setting detecting sensors;

transmitting lock setting data to the safety control; and determining shaft region data having details with respect to shaft regions in which each cage is safely movable from the cage position data and the lock setting data.

15. The method according to claim 14, including transmitting the shaft region data to the drive control and converting the shaft region data by the drive control into drive control signals.

16. The method according to claim 15,.including moving the cages pursuant to shaft region data in safe shaft regions in which the cage with preservation of a safety spacing from a next cage or from the shaft end and with normal retardation can move to a next storey stop as seen in a travel direction of the cage and stop there.

17. The method according to claim 15, including moving the cages at a safety spacing which is equal to an entire braking travel of the cages with normal retardation.

18. The method according to claim 15, further including checking serviceability of the cage position detecting sensors and the lock setting detecting sensors with the safety control by way of a data bus.

19. The method according to claim 15, including retarding at least one drive in case of exceeding a safety-critical spacing as a first safety measure and/or emergency braking at least one drive as a further safety measure and/or engaging at least one safety brake device of the cages as a further safety measure.

* * * * *